US005291813A

United States Patent [19]

Blumenthal et al.

[11] Patent Number: 5,291,813

[45] Date of Patent: Mar. 8, 1994

[54] PAPER PERFORATING DEVICE

[75] Inventors: David S. Blumenthal, Natick; Richard Somersall, Sherborn; Steven Pauplis, Paxton, all of Mass.

[73] Assignee: Clix Products, Inc., Natick, Mass.

[21] Appl. No.: 61,427

[22] Filed: May 6, 1993

Related U.S. Application Data

[63] Continuation of Ser. No. 863,815, Apr. 6, 1992, abandoned.

[51] Int. Cl.[5] ..... B26F 1/32

[52] U.S. Cl. ..... 83/599; 16/386; 30/356; 402/1; 402/4

[58] Field of Search ..... 30/358, 360, 361, 363; 402/1, 4; 16/386; 83/599

[56] References Cited

U.S. PATENT DOCUMENTS

| | | | |
|---|---|---|---|
| 1,142,032 | 6/1915 | Faifer | 402/1 |
| 1,567,643 | 12/1925 | Hearne | 402/4 |
| 2,139,159 | 12/1938 | Hammen | 402/1 |
| 2,370,319 | 2/1945 | Lippincott | 402/1 |
| 2,495,687 | 1/1950 | Belmon | 402/4 |
| 3,000,049 | 9/1961 | Terry, Jr. | 16/386 |
| 3,372,482 | 3/1968 | Mercorelli | 30/363 |
| 3,975,105 | 8/1976 | Cline | 30/358 |

FOREIGN PATENT DOCUMENTS

| | | | |
|---|---|---|---|
| 1016630 | 1/1966 | United Kingdom | 402/1 |
| 2209133 | 5/1989 | United Kingdom | 30/358 |

*Primary Examiner*—Hien H. Phan

*Attorney, Agent, or Firm*—Morse, Altman, Dacey & Benson

[57] ABSTRACT

A sheet perforating punch formed of hard polymeric material formed of a punch plate with punching teeth and a die plate with holes intended to be registered with the teeth, snap-together hinging being provided for rotatably coupling the two plates together along respective edges thereof so that the registration of corresponding ones of the holes and teeth are fixed and so that no discernible relative axial displacement or travel of the two plates is permitted.

6 Claims, 2 Drawing Sheets

PAPER PERFORATING DEVICE

This is a continuation of copending U.S. patent application Ser. No. 07/863,815 filed Apr. 6, 1992, now abandoned.

This invention relates to devices for punching holes in sheet materials, and particularly to such a device adapted and constructed for carrying in a ring binder.

It is known to include a perforating device in a ring binder, so that edge portions of paper sheets can be readily perforated for insertion into the rings of the binder For example, U.S. Pat. No. 3,172,325 issued Mar. 9, 1965 to S. C. Wernham et al discloses such a perforating device employing a metallic punch mounted on a plastic body that can be itself installed on the rings of a binder for ready storage and access. That disclosure notes that it is almost essential that the punch be made of metal for accurate punching. The device is basically formed, as are many others, of an elongated die plate having a plurality of holes therein, and an elongated punch plate having a corresponding plurality of punch teeth positioned and dimensioned to fit snugly within the holes in the die plate. The two plates are movably hinged to one another along common elongated edges so that they can be moved into a position wherein the teeth engage in the holes and punch corresponding openings into a sheet captured therebetween.

A major problem arising out of the use of comparatively inexpensive, high molecular weight polymers (hereinafter "plastics") for the working parts of paper punches is that unless strict registration is maintained between the punch teeth and the die holes, misalignment will cause the teeth to wear very rapidly by engagement with the edges of the die holes or fail to effect the desired punching. The problem is exacerbated when using plastic materials that tend to be less rigid than metals and otherwise more readily deformable and less resistant to wear. Further, many paper punches formed of plastic are easily disassembled, and after several separations and reconnections, both the rotation of the hinges and the registration of holes and teeth are degraded seriously, rendering the punch relatively ineffective.

Accordingly, it is a principal object of the present invention to provide an improved, inexpensive punching device for perforating sheets for insertion in a ring binder and which itself may be installed on the rings of the binder for ready access and use.

Yet other objects of the present invention are to provide a punching device of the type described constructed of plastic and comprising means for maintaining strict registration between the punch teeth and die holes; to provide such a device that is easy and simple to operate; and to provide such a device that comprises a pair of elongated plates, movably hinged to one another along common elongated edges, such plates respectively bearing punch teeth and die holes, and means for preventing substantially any longitudinal motion of the plates with respect to one another so as to maintain the registrability of said teeth and holes with one another.

Other objects of the present invention will impart appear obvious and will in part appear hereinafter. The invention accordingly comprises the apparatus embodying features construction, combinations of elements, and arrangement of parts, all as exemplified in the following detailed disclosure, and the scope of the application of which will be indicated in the claims.

For a fuller understanding of the nature and objects of the invention, reference should be had to the following detailed description taken in connection with the accompanying drawings, wherein like numerals denote like parts, and wherein.

Figure 1:
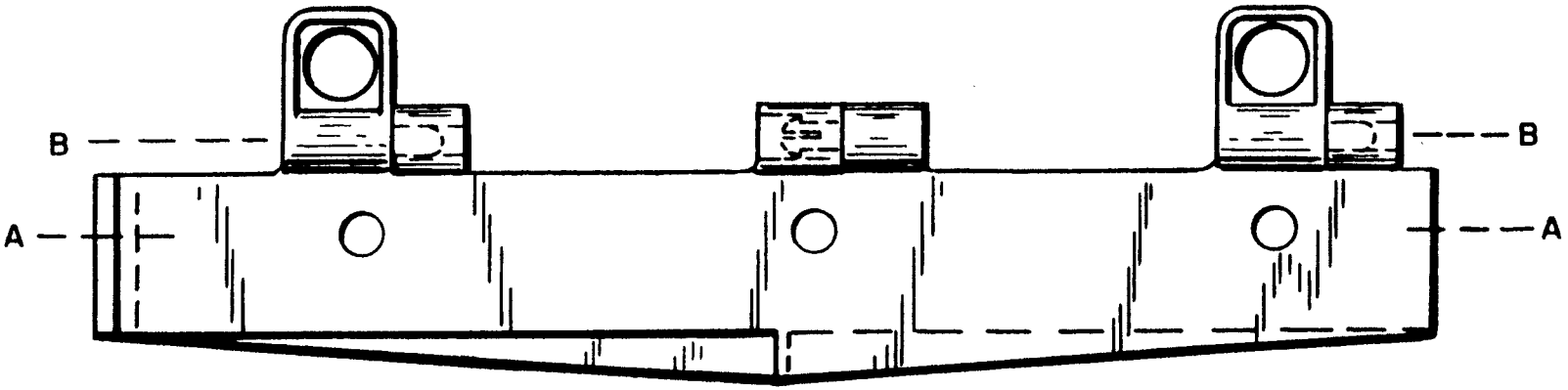
FIG. 1 is a top view of an assembled perforating device of the present invention, partly in broken lines.

To effect the foregoing and other objects, there is shown in the Figures various aspects of perforating device 20 embodying the principles of the present invention, and including a pair of elongated, substantially flat or planar, approximately rectangular plates such as die plate 21 and punch plate 22. Each of plates 21 and 22 is preferably formed entirely of hard, rigid, light-weight plastic material such as ABS, phenol-formaldehyde, polyvinyl chloride or the like, typically in a molding operation, by machining from a cast or calendared blank, or the like.

Plate 21 includes a plurality of openings or holes 24 therethrough, spaced-apart from one another along a first common axis A—A extending along the length of the plate. The spacing or separation between the centers of holes 24 is selected to correspond to the distances between the several rings of a loose-plate binder, or the like, in which perforating device 20 is intended to be stored device is intend to perforate sheet material. While holes 24 can be of many different configurations, they typically will have circular cross-sections and be substantially cylindrical, extending normally to and through the plane of plate 21.

Plate 22 includes a plurality of integrally formed, plastic punch teeth 26 projecting normally to the flat surface of plate 22 and spaced-apart from one another in the same manner as the spacing of holes 24 along first common axis A—A. Teeth 26 typically are provided with cutting edges or conical points on their distal ends and are dimensioned and shaped to have cross-sections configurations and diameters matched to those of holes 24. The longitudinal dimensions of the two plates are preferably, but not necessarily, similar.

At least one of the plates, preferably plate 21 which will be considered the "bottom" plate, includes at one end thereof, a projection such as upstanding edge gauge 27 against which an edge of a sheet is intended to abut to position the sheet along the longer axis of the plate prior to and while perforating the sheet. Similarly, means, in the form of a plurality of paper stops 28, preferably formed integrally with plate 21 to project upwardly from the plane of plate 21 and positioned along a line parallel to and spaced from axis A—A, are provided for positioning such a sheet along the shorter axis of the plate. One of the long edges, edge 30, of plate 21 is a substantially straight edge directed substantially parallel to axis A—A. Plate 21 is also shaped to provide at least a pair of ears 32 extending outwardly from edge 30 in the plane of the plate perpendicularly edge 30, each ear having a large hole 34 therein. Holes 34 are separated from one another by the distance between the outermost rings of a loose-plate binder, or the like, in which perforating device 20 is intended to be stored, so that the perforating device can readily be mounted on such rings.

The opposite longer edge of plate 21 is formed of several portions, a first of which, first straight edge portion 36 extends at a predetermined distance from and substantially parallel to axis A—A from one end of plate 21 to an approximate midpoint along the longer dimension of the plate. The opposite longer edge of plate 21 also includes second edge portion 37 extending from the opposite end of plate 21 to that midpoint but at a shallow angle to axis A—A, thereby forming tongue 38 extending outwardly in the plane of the plate.

Similarly, one of the longer edges, edge 40, of plate 22 is a substantially straight edge directed substantially parallel to axis A—A. Also, the other longer edge of plate 22 is formed of at least two portions, a first of which, first straight edge portion 41 extends also substantially parallel to axis A—A from one end of plate 22 to an approximate midpoint along the longer dimension of plate 22. The opposite longer edge of plate 22 also includes second edge portion 42 extending from the other end of plate 22 to the midpoint but at a shallow angle to axis A—A, thereby forming tongue 44 extending outwardly in the plane of the plate. The respective tongues 38 and 44 are arranged so that if plate 22, the "upper plate" is stacked above and parallel to bottom plate 21 with edges 40 and 30 aligned adjacent and parallel to one another, the tongues overlie respective straight edge portions 36 and 41.

The two plates are movably hinged to one another, preferably at three points along a second common axis B—B extending parallel to axis A—A adjacent respective longitudinal edges 40 and 30 of the plates, so that the plates may be folded around the hinging to a position wherein they lie substantially against one another in parallel planes. As means for hinging the two plates together, one of the plates, such as plate 21 is provided with means supporting respective elongated plastic posts 56 and 57, each post being formed integrally with a corresponding one of ears 32. The long axis of each post extends perpendicularly from a flat portion of a corresponding shoulder on a corresponding one of ears 32, parallel to and spaced from edge 30 so as to be colinear with axis B—B. Each of posts 56 and 57 can be formed as a simple cylinder having a predetermined diameter.

As part of the hinging mechanism in the present invention, plate 22 is shaped to provide three supporting members 52, 53 and 54 projecting normally to edge 40 at three respective locations, the outer two members 52 and 54 being spaced outwardly from one another by about the same distance as the spacing between the bases of posts 56 and 57. Formed as part of members 52 and 54 are means defining respective tubular, cylindrically hollow plastic sockets 46 the interiors of each of which extends preferably completely though the opposite openings on the sides of the corresponding member. The respective cylindrical axes of each such tubular interior hollow 46 of the sockets are each disposed colinearly with axis B—B. Each of sockets 46 has an inside diameter dimensioned so that posts 56 and 57 are capable of fitting snugly but rotatably within the respective sockets.

A third means defining a hollow cylindrical plastic socket 48 is provided in the form of a projection extending outwardly from edge 30 of plate 21 and having a hollow cylindrically tubular interior extending from side to side through socket 48 such that the cylindrical axis of socket 48 is also colinear with axis B—B. Unlike sockets 46, the cylindrical interior of socket 48 is formed of two colinear tubular sections 49 and 50, the latter being of greater diameter than the other so as to provide an intermediate internal ring or shoulder 51 spaced a carefully predetermined distance D from a flat outer side of the socket at the outer end of section 49.

Figure 2:
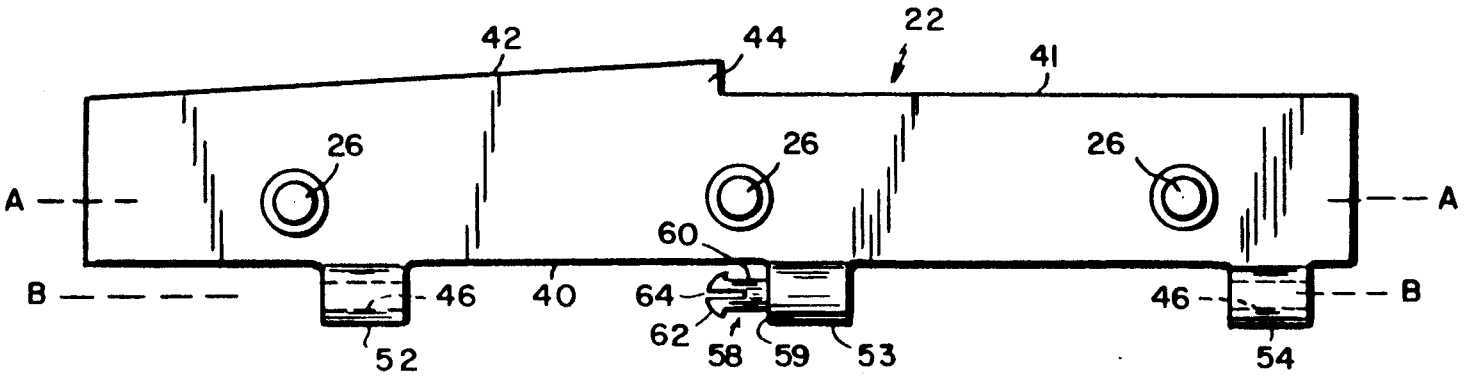
FIG. 2 is a top view of the elongated die plate of FIG. 1.
Figure 3:
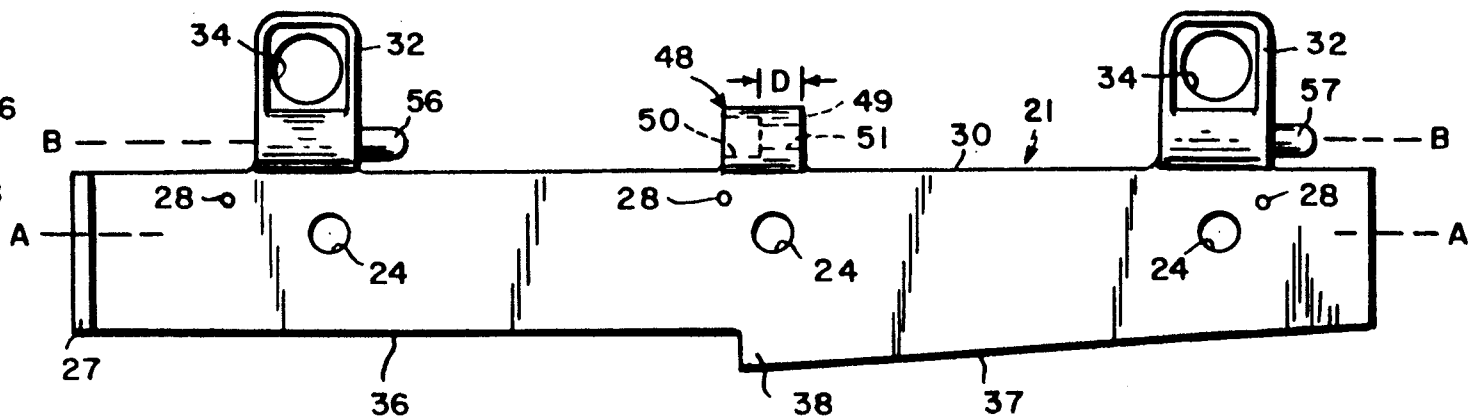
FIG. 3 is a top view of an elongated punch plate of FIG. 1.
Figure 4:
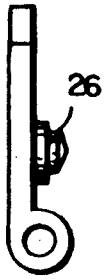
FIG. 4 is a cross-sectional view taken along the line 4—4 in FIG. 2.
Figure 5:
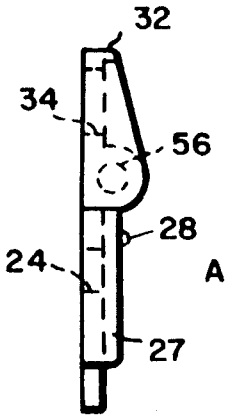
FIG. 5 is a cross-sectional view taken along the line 5—5 of FIG. 3.

As shown particularly in FIG. 2, middle member 53, disposed between members 52 and 54, supports an elongated post 58 formed integrally with member 53. The long axis of post 58 also extends perpendicularly from a flat face of a corresponding shoulder 59 on member 53, that long axis being parallel to and spaced from edge 40 so as to be colinear with axis B—B. Post 58 is formed of a stiff but elastically deformable polymer as cylindrical shaft 60 extending integrally outwardly from shoulder 59, the outer end of shaft 60 being capped with rounded head 62. The length of shaft 60 between shoulder 59 and the bottom of head 62 is preferably the distance D which is essentially the length of tubular section 49 in socket 48. The maximum cross-sectional diameter of head 62 where it joins shaft 60 is somewhat greater than the diameter of the shaft itself which in turn is substantially the same diameter as the smaller-diameter section 49 of socket 48. Head 62 is provided with a deep axially directed slot 64 that extends into shaft 60 as well.

The two plates are joined together by placing them so that their planes are substantially parallel with posts 56 and 57 colinear with tubular interiors 47 of sockets 46, and post 58 similarly colinear with tubular interior of socket 48 with teeth 26 facing toward plate 21. As the plates are moved longitudinally relative to one another so as to insert the respective posts into their corresponding sockets, posts 56 and 57 will simply slide into the corresponding sockets. Because head 62 of post 58 is of larger diameter than tubular section 49, the post will be forced to compress or distort radially because of the presence of slot 64 so that it can be inserted into section 49. When head 62 reaches shoulder 51, because of the larger diameter of section 50, head 62 will be free to expand elastically to its original configuration. The underside of the head then bears snugly against shoulder 51 because of the equality of length of shaft 69 and section 49, thus locking post 58 against any axial motion while permitting radial rotation thereof within socket 48. With the two plates so coupled, corresponding holes 24 and teeth 26 will be registrable with one another. The hinge mechanism thus provided permits ready rotatability of plates 21 and 22 relative to one another, while permitting no discernible relative axial displacement or travel of the two plates, thereby preserving the registration of the respective teeth 26 and holes 24. Such a hinge mechanism is locked against axial motion because of the head 62, having a greater diameter than tubular section 49, cannot readily be withdraw from the latter. Thus one cannot readily disassemble the device without deliberately destroying or seriously damaging the hinging, thereby discouraging individuals from attempting to separate the plates and seriously impairing the axial restraint on motion.

It should be noted also that because, when assembled, tongues 38 and 44 are staggered or offset with respect to one another and are not congruent, one can grasp either plate by the corresponding tongue and readily rotate them relative to each other. This serves to overcome the problem that exists when the respective edges of the plates of a punch lie substantially along the same line and therefore present problems of separation manually.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. A punch device for providing holes in sheet material, and comprising;

an elongated, substantially flat die plate formed of substantially rigid, hard, polymeric material and having a plurality of holes therethrough predeterminedly spaced from one another and disposed along a first linear axis;

an elongated, substantially flat punch plate also formed of substantially rigid, hard polymeric material and having a plurality of teeth projecting therefrom in said predetermined spacing and disposed along a second linear axis;

means, formed of polymeric material, for rotatably hinging said two plates together along respective edges thereof so that holes and teeth are in fixed registration with one another and so that no discernible relative axial displacement or travel of said two plates is permitted, said means comprising a plurality of elongated posts fixed to at least one of said plates, and a like plurality of corresponding tubular sockets fixed to the other of said plates, said posts and sockets being so arranged that said posts extend colinearly with one another into respective ones of said sockets and said sockets are rotatable about said posts, said means being so dimensioned and constructed that when said posts are fully extended within said sockets, said posts and sockets cannot be disengaged without seriously damaging said hinging.

2. A punch device as set forth in claim 1 wherein said means for hinging is so dimensioned and constructed that said first and second axes are maintained parallel to one another and said plates are rotatable about a third axis parallel to and spaced from said first and second axes.

3. A punch device as defined in claim 1 wherein the unhinged edges of said plates, opposite to said respective edges, are angularly offset from one another so as to be non-parallel and to permit ready manipulation for rotating said plates relative to one another about a common axis adjacent said respective edges.

4. A punch device as defined in claim 1 wherein one of said plates includes a pair of flat ears extending outwardly from said one of said plates in the plane thereof, each of said ears having an aperture therein, said apertures being spaced apart by a distance equal to that between the outermost rings of a loose-leaf binder in which said punch can be stored, at least two of said posts each being respectively mounted on edges of corresponding ones of said ears so that the axes of elongated of said posts extend colinearly substantially perpendicularly to said edges of said ears substantially in the plane of said one of said plates.

5. A punch device as defined in claim 1 wherein one of said elongated posts is mounted on one of said plates adjacent an edge thereof so that the long axis of said post is parallel to and spaced from said edge, said one of said elongated posts being formed of a stiff but elastically deformable polymer and including a cylindrical shaft of predetermined length, one end of said shaft bearing a rounded head;

a tubular polymeric socket mounted on the other of said plates adjacent an edge thereof so that the axis of elongation of said socket is parallel to and spaced from said edge, the interior of said socket being formed of two colinear tubular sections one of which is of greater diameter than the other so as to define at one end of the tubular section of lesser diameter, an intermediate internal shoulder spaced from the other end of said tubular section of lesser diameter by said predetermined length, said smaller-diameter section having substantially the same diameter as said shaft, and the diameter of said head being greater than the diameter of said shaft;

said head having an axially directed slot therein to permit said head to be distorted sufficiently in diameter to be inserted into said tubular section of lesser diameter.

6. A punch device as defined in claim 5 including at least a pair of other posts extending colinearly with said shaft and a pair of elongated sockets in which said other posts can be rotatably inserted, the axes of said sockets extending colinearly with the axis of said tubular section.

* * * * *